US006508280B2

(12) United States Patent
Capstran

(10) Patent No.: US 6,508,280 B2
(45) Date of Patent: Jan. 21, 2003

(54) COMBINED OIL DRAIN AND FILL APPARATUS FOR AN ENGINE

(76) Inventor: Richard E. Capstran, 1741 Alta Vista, Wauwatosa, WI (US) 53213

( * ) Notice: Subject to any disclaimer, the term of this patent is extended or adjusted under 35 U.S.C. 154(b) by 40 days.

(21) Appl. No.: 09/866,144

(22) Filed: May 26, 2001

(65) Prior Publication Data

US 2002/0023691 A1 Feb. 28, 2002

Related U.S. Application Data

(60) Provisional application No. 60/226,149, filed on Aug. 16, 2000.

(51) Int. Cl.[7] ..... B65B 1/04

(52) U.S. Cl. ..... 141/98; 141/65; 141/59; 184/1.5

(58) Field of Search ..... 141/65, 67, 98, 141/59, 94, 95; 184/1.5

(56) References Cited

U.S. PATENT DOCUMENTS 4,938,315 A * 7/1990 Ohta et al. ..... 184/1.5
5,056,621 A 10/1991 Trevino ..... 184/1.5
5,263,445 A 11/1993 Bedi et al. ..... 123/196.005
5,415,247 A 5/1995 Knorr ..... 184/1.5
5,554,278 A * 9/1996 Henderson ..... 123/575
5,787,372 A * 7/1998 Edwards et al. ..... 123/198 DA
6,123,174 A * 9/2000 Elkin et al. ..... 123/196 S

* cited by examiner

*Primary Examiner*—Steven O. Douglas
(74) *Attorney, Agent, or Firm*—Donald J. Ersler

(57) ABSTRACT

A combined oil drain and fill apparatus includes an oil supply container, oil waste container, supply pump, waste pump, supply check valve, waste check valve, Y-connector, and oil hose. One end of the supply pump is connected to the supply container and the other end is connected to the supply check valve. One end of the waste pump is connected to the waste container and the other end is connected to the waste check valve. The Y-connector has two inlets and one outlet. The supply and waste check valves are connected to the inlets of the Y-connector and the oil hose is connected to the outlet of the Y-connector. The supply and waste check valves may be replaced with a supply shut-off valve and a waste shut-off valve.

12 Claims, 1 Drawing Sheet

COMBINED OIL DRAIN AND FILL APPARATUS FOR AN ENGINE

CROSS-REFERENCES TO RELATED APPLICATIONS

This is a utility patent application having priority from provisional application No. 60/226,149 filed on Aug. 16, 2000.

BACKGROUND OF THE INVENTION

1. Field of the Invention

The present invention relates generally to maintenance of internal combustion engines and more specifically to a combined oil drain and fill apparatus which allows a single tube to be inserted into an oil fill access only once to drain and fill an engine.

2. Discussion of the Prior Art

Currently, there is a device on the market which allows oil in an engine to be drained therefrom by placing a tube in an oil fill opening or down a dip stick tube. There is also a device on the market which is inserted into the oil fill opening and fills the engine with oil under pressure to decrease the fill time. U.S. Pat. No. 5,415,247 to Knorr, U.S. Pat. No. 5,263,445 to Bedi et al., and U.S. Pat. No. 5,056,621 to Trevino disclose the combined draining and filling of oil from an engine.

Accordingly, there is a clearly felt need in the art for an a combined oil drain and fill apparatus which allows a single tube to be inserted in to an oil fill access only once to drain and fill an engine.

SUMMARY OF THE INVENTION

The present invention provides a combined oil drain and fill apparatus which allows an oil change to be completed in less time. The combined oil drain and fill apparatus includes an oil supply container, oil waste container, supply pump, waste pump, supply check valve, waste check valve, Y-connector, and oil hose. The supply and waste pumps may be either manual or automatic type. One end of the supply pump is connected to the oil supply container and the other end is connected to one end of the supply check valve through a supply hose. One end of the waste pump is connected to the waste container and the other end is connected to one end of the waste check valve through a waste hose. The other ends of the supply and waste check valves are attached to the inlets of the Y-connector. The outlet of the Y-connector is connected to the oil hose.

The oil hose is inserted into an oil fill access of an engine. The oil fill access must allow the oil hose to be inserted to a bottom of the crank case of an engine. After the oil hose is inserted to the bottom of the crank case, the waste pump is activated. The waste pump draws used oil from the crank case and pushes thereof into the waste container through the waste check valve. The supply check valve prevents used oil from flowing into the supply container. After all the used oil has been pumped out of the crank case, the supply pump is activated. The supply pump draws fresh oil from the supply container and pushes thereof into the crank case through the supply check valve. The waste check valve prevents used oil from being accidentally pumped back into the crankcase. In a second embodiment of the combined oil drain and fill apparatus, the check valves are replaced with a supply shut-off valve and a waste shut-off valve. The shutoff valves must be manually turned on and off to remove used oil and supply fresh oil to the crank case.

Accordingly, it is an object of the present invention to provide a combined oil drain and fill apparatus which allows a tube to be inserted in to an oil fill access only once to drain and fill an engine.

Finally, it is another object of the present invention to provide a combined oil drain and fill apparatus which decreases the amount of time required to do an oil change on an engine.

These and additional objects, advantages, features and benefits of the present invention will become apparent from the following specification.

DETAILED DESCRIPTION OF THE PREFERRED EMBODIMENTS

Figure 1:
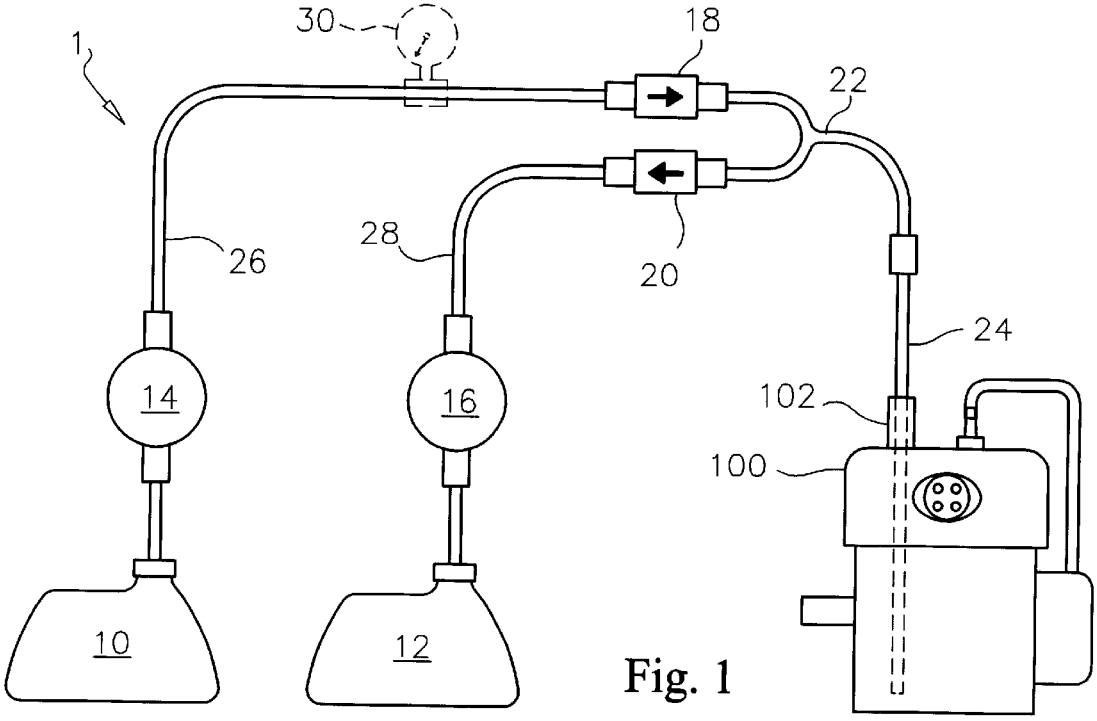
FIG. 1 is a schematic diagram of a combined oil drain and fill apparatus with check valves in accordance with the present invention.
Figure 2:
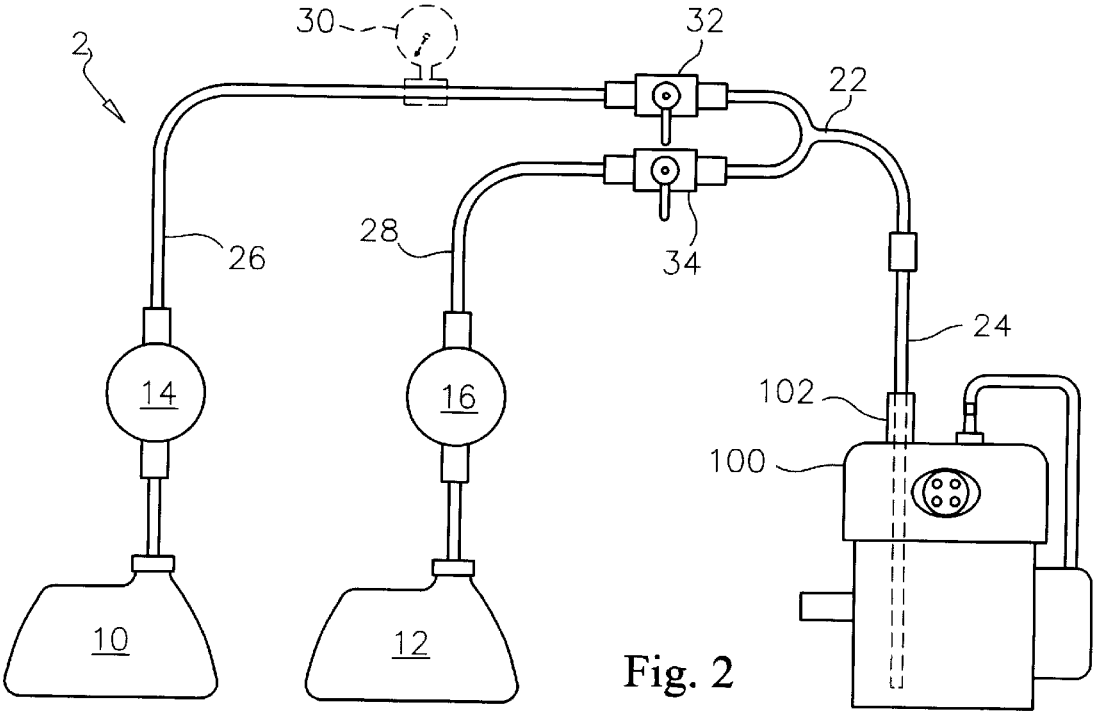
FIG. 2 is a schematic diagram of a combined oil drain and fill apparatus with shut-off valves in accordance with the present invention.

With reference now to the drawings, and particularly to FIG. 1, there is shown a schematic diagram of a combined oil drain and fill apparatus 1. The combined oil drain and fill apparatus 1 includes an oil supply container 10, oil waste container 12, supply pump 14, waste pump 16, supply check valve 18, waste check valve 20, Y-connector 22, and oil hose 24. One end of the supply pump 14 is connected to the oil supply container 10 and the other end is connected to one end of the supply check valve 18 through a supply hose 26. The supply check valve 18 only allows the flow of fresh oil toward a crank case of the engine 100. One end of the waste pump 16 is connected to the waste container 12 and the other end is connected to one end of the waste check valve 20 through a waste hose 28. The waste check valve 20 only allows used oil to flow from the crank case of the engine 100 into the waste container 12.

The supply and waste pumps may be either manual or automatic type. It is preferable to use a manual type of pump for draining and refilling a lawn mower engine or any type of small engine to reduce the cost. If an automatic type of pump is used, it is preferable to use a diaphragm pump. The diaphragm pump may be placed in a pumping or vacuum mode. The other ends of the supply and waste check valves are attached to the inlets of the Y-connector 22. The outlet of the Y-connector is connected to the oil hose 24. The smaller versions of the combined oil drain and fill apparatus 1 may be contained in a single carrying case. Larger versions of the combined oil drain and fill apparatus 1 may be placed on a movable cart.

The oil hose 24 is inserted into an oil fill access 102 of the engine 100. The oil fill access 102 may be an oil fill opening or a dip stick tube. The oil fill access 102 must allow the oil hose 24 to be inserted to a bottom of the crank case. After the oil hose 24 is inserted to the bottom of the crank case, the waste pump 16 is activated. The waste pump 16 draws used oil from the crank case and pushes thereof into the waste container 12 through the waste check valve 20. After all the used oil has been pumped out of the crank case, the waste pump is deactivated and the supply pump 14 is activated. The operator will hear an air gurgling sound when all the oil is drained from the crank case. The supply pump 14 draws fresh oil from the supply container 10 and pushes thereof into the crank case through the supply check valve

18. The crank case of the engine 100 may be filled with the correct amount of oil by placing the needed amount of oil in the supply container 10 before pumping. However, the correct amount of oil may be monitored using an optional flow indicator 30. The flow indicator 30 displays the amount of oil which has passed through the supply hose 26. The flow indicator 30 is preferably connected in the length of the supply hose 26 or between the supply check valve 18 and an inlet of the Y-connector 22.

In a second embodiment of the combined oil drain and fill apparatus 2, the supply and waste check valves are replaced with a supply shut-off valve 32 and the waste shut-off valve 34. After the oil hose 24 is inserted to the bottom of the crank case, the supply and waste pumps are turned on. The supply pump 14 is put in pumping mode and the waste pump is put in vacuum mode. The waste shut-off valve 34 is opened until the crank case of the engine 100 is drained of oil therein. The operator will hear an air gurgling sound when all the oil is drained from the crank case. The waste value 34 is closed and the supply valve 32 is opened. After the engine 100 is filled with the correct amount of oil, the waste valve 20 is closed and the oil hose 24 is removed from the oil fill access 102.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A combined oil drain and fill apparatus comprising:

an oil supply pump;

an oil waste pump;

a supply container being attached to one end of said oil supply pump;

an oil waste container being attached to one end of said oil waste pump;

a Y-connector having two inlets and an outlet, an oil hose being connected to said outlet;

a check valve having one end connected to the other end of said supply pump and the other end being an integral portion of one of said two inlets of said Y-connector; and a waste check valve having one end connected to the other end of said waste pump and the other end being an integral portion of the other one of said two inlets of said Y-connector.

2. The combined oil drain and fill apparatus of claim 1, wherein:

said oil pumps being manual type pumps.

3. The combined oil drain and fill apparatus of claim 1, wherein:

said oil pumps being automatic type pumps.

4. The combined oil drain and fill apparatus of claim 1, wherein:

a supply hose being inserted between said other end of said supply pump and said one end of supply check valve.

5. The combined oil drain and fill apparatus of claim 1, wherein:

a waste hose being inserted between said other end of said waste pump and said one end of waste check valve.

6. The combined oil drain and fill apparatus of claim 1, further comprising:

a flow indicator being utilized to measure the amount of oil pumped.

7. A method of draining and filling an engine with oil comprising the steps of:

(a) providing a supply container;

(b) providing a waste container (c) providing a Y-connector having two inlets and a single outlet tube;

(d) pumping used oil from a crank case of an engine through said outlet tube to said waste container through a waste check valve, said waste check valve being connected to one of said inlets; and (e) pumping fresh oil from said supply container to the crank case of the engine through a supply check valve, said supply check valve being connected to the other said inlet.

8. The method of draining and filling an engine with oil of claim 7 wherein:

said pumping being implemented with a manual type of pump.

9. The method of draining and filling an engine with oil of claim 8 wherein:

said pumping being implemented with an automatic type of pump.

10. The method of draining and filling an engine with oil of claim 8 wherein:

a supply hose being connected between said supply pump and said supply check valve.

11. The method of draining and filling an engine with oil of claim 8 wherein:

a waste hose being connected between said waste pump and said waste check valve.

12. The method of draining and filling an engine with oil of claim 8 wherein:

a flow indicator being used to measure the amount of oil pumped.

* * * * *